US008079644B1

(12) United States Patent
Pangilinan

(10) Patent No.: US 8,079,644 B1
(45) Date of Patent: Dec. 20, 2011

(54) ERGONOMIC FOOTREST

(76) Inventor: Maria H. Pangilinan, Norwalk, CA (US)

( * ) Notice: Subject to any disclaimer, the term of this patent is extended or adjusted under 35 U.S.C. 154(b) by 867 days.

(21) Appl. No.: 11/443,874

(22) Filed: May 31, 2006

Related U.S. Application Data

(60) Provisional application No. 60/685,956, filed on May 31, 2005.

(51) Int. Cl.
*A47C 9/00* (2006.01)

(52) U.S. Cl. ..... 297/461; 297/423.41; 297/344.12; 297/423.1; 108/93

(58) Field of Classification Search ..... 108/65, 108/90, 93, 144.11, 1–9, 147; 248/425, 405, 248/371, 118, 118.1, 118.3, 118.5, 461; 297/423.1, 297/423.38, 107, 120, 144, 423.41, 423.44, 297/344.12, 344.21, 344.22, 461, 423.45
See application file for complete search history.

(56) References Cited

U.S. PATENT DOCUMENTS

| | | | | | |
|---|---|---|---|---|---|
| 3,406,933 | A * | 10/1968 | Wait et al. | 248/80 |
| 5,293,825 | A * | 3/1994 | Cauffiel | 108/49 |
| 5,655,743 | A * | 8/1997 | Gillis | 248/346.01 |
| 5,722,627 | A * | 3/1998 | Hoshino | 248/405 |
| 5,765,921 | A * | 6/1998 | Chuang | 297/423.46 |
| 6,003,944 | A * | 12/1999 | Glockl | 297/337 |
| 6,030,045 | A * | 2/2000 | Hoshino | 297/461 |
| 6,045,098 | A * | 4/2000 | Timm | 248/118 |
| 6,079,676 | A * | 6/2000 | Hackett et al. | 248/118 |
| 6,174,026 | B1 * | 1/2001 | Wise | 297/120 |
| 6,637,350 | B2 * | 10/2003 | McKsymick | 108/25 |
| 6,648,430 | B2 * | 11/2003 | Rohde et al. | 312/301 |
| 6,694,895 | B2 * | 2/2004 | Gillis | 108/102 |
| 6,823,802 | B2 * | 11/2004 | Butts, Jr. | 108/25 |
| 7,201,353 | B1 * | 4/2007 | Freeman | 248/161 |

* cited by examiner

*Primary Examiner* — David Dunn
*Assistant Examiner* — Erika Garrett
(74) *Attorney, Agent, or Firm* — Kenneth L Tolar

(57) ABSTRACT

An ergonomic footrest includes a substantially planar platform having a pair of lateral extensions. A support structure suspends the platform a desired distance above an underlying surface. The support structure includes means for adjusting the height and angle of the platform.

8 Claims, 2 Drawing Sheets

ERGONOMIC FOOTREST

CROSS REFERENCE TO RELATED APPLICATIONS

This application is entitled to the benefit of provisional application No. 60/685,956 filed on May 31, 2005, the specification of which is incorporated herein by reference.

BACKGROUND OF THE INVENTION

The present invention relates to a height variable and angularly adjustable footrest.

DESCRIPTION OF THE PRIOR ART

Many people, particularly those who stand for prolonged durations, must routinely rest their feet. Furthermore, people who remain seated for extended durations must periodically rest or elevate their feet to promote proper circulation. Although a myriad of footrests exist in the prior art, most have a fixed height and orientation. The present invention provides a uniquely designed footrest that allows a user to vary the height and angular orientation thereof.

SUMMARY OF THE INVENTION

The present invention relates to an ergonomic footrest. The device comprises a substantially planar footrest platform having an upper surface, a lower surface and two opposing sides. Each side includes an opening in communication with a hollow interior having a pair of extensions received therein. Each extension is slidable into and out of the opening to increase the width of the platform, if desired. Secured to the bottom surface of the platform are a pair of spaced, substantially circular restraining rings each having an annular, serrated inwardly facing surface. A support structure suspends the platform above an underlying surface. The support structure includes means for varying the height and angular orientation of the platform.

It is therefore an object of the present invention to provide a footrest that is ergonomical.

It is another object of the present invention to provide a footrest that is both height and angularly adjustable.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
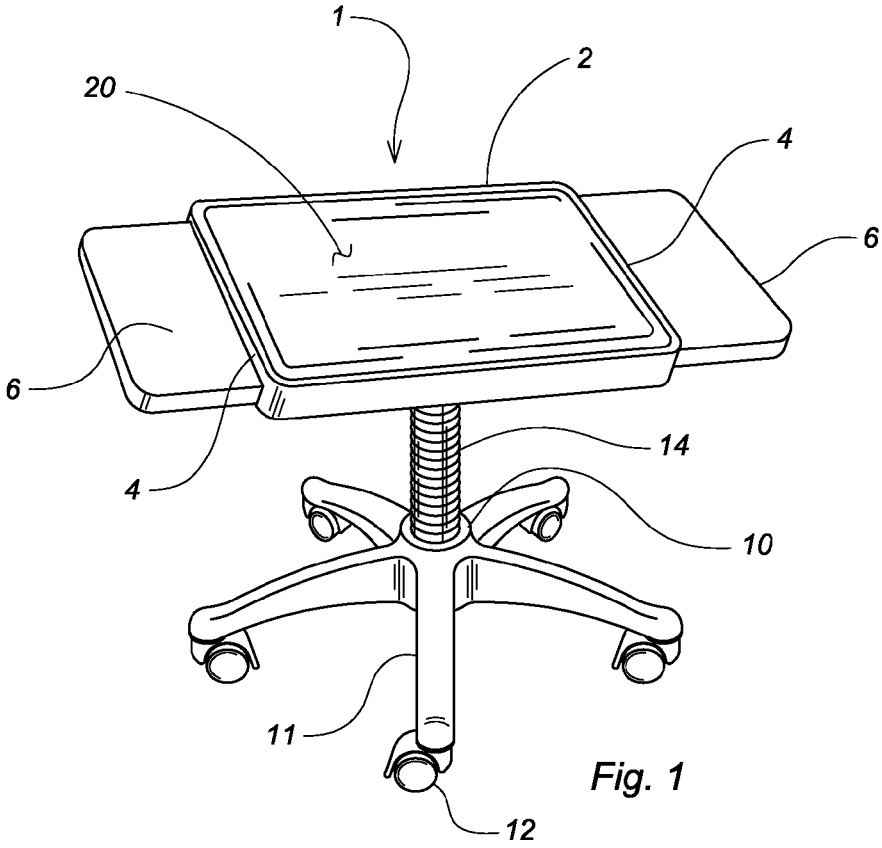
FIG. 1 is a perspective view of the footrest according to the present invention.
Figure 5:
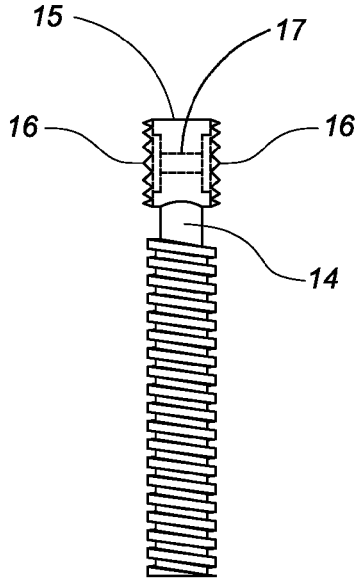
FIG. 5 is a side view of the support rod.
Figure 6:
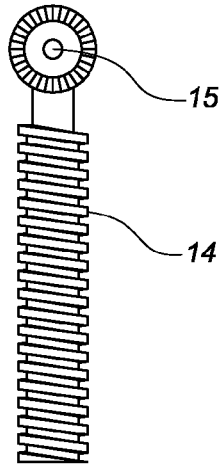
FIG. 6 is a front, plan view of the support rod.
Figure 2:
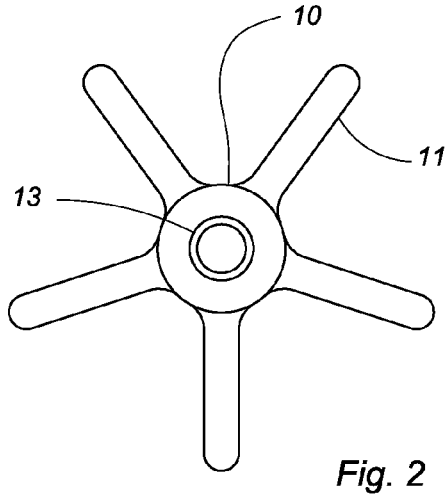
FIG. 2 is a top view of the support hub of the present invention.
Figure 3:
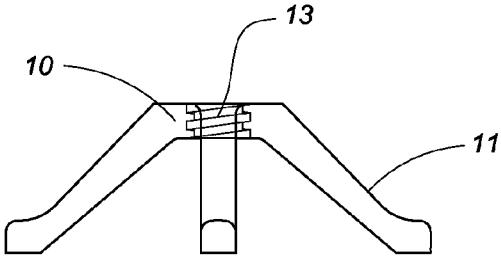
FIG. 3 is a front, plan view of the support hub.
Figure 4:
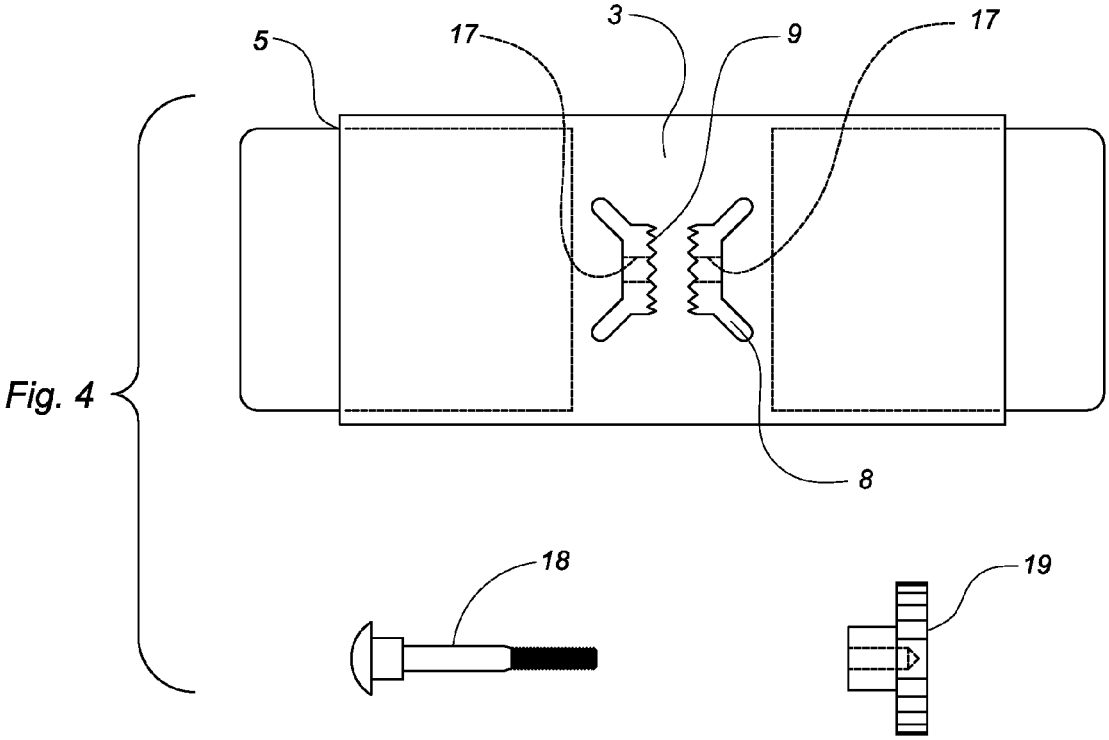
FIG. 4 is a bottom view of the platform.

The present invention relates to an ergonomic footrest. The device comprises a substantially planar footrest platform 1 having an upper surface 2, a lower surface 3 and two opposing sides 4. A rubber or cushioned layer 20 may be positioned on the upper surface of the platform for enhanced comfort. Each side includes an opening 5 in communication with a hollow interior having a pair of extensions 6 received therein. Each extension is slidable into and out of the opening to increase the width of the platform, if desired. Secured to the bottom surface of the platform are a pair of spaced, substantially circular restraining rings 8 each having an annular, serrated inner surface 9.

A support structure suspends the platform a select distance above an underlying surface. The support structure includes a hub 10 having a plurality of support legs 11 radially extending therefrom. At a distal end of each support leg is a locking caster 12. The hub includes a centrally disposed, internally threaded bore 13 that receives an elongated, externally threaded support rod 14. At an upper end of the rod is an insert 15 having a continuous, annular geared surface 16 on each of two opposing sides thereof. The geared surfaces of the insert intermesh with the serrated surfaces of the restraining rings when the insert is positioned therebetween to fix the platform at a select angle. The restraining rings and insert each include a horizontal passageway 17 that receives a carriage bolt 18. A knob 19 is threadedly secured to the carriage bolt which is tightened to firmly secure the support rod to the platform.

To vary the angle of the platform, the knob is loosened, the platform is pivoted to the desired angle and the knob is retightened. To adjust the height of the platform, it is rotated either clockwise or counterclockwise to retract or extend the rod from the hub bore.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An ergonomic footrest comprising:

a substantially planar footrest platform having an upper surface, a lower surface and two opposing sides, each of said sides including an opening in communication with a hollow interior;

a cushioned layer positioned on the upper surface of the platform for enhanced comfort;

an extension slidably received within said opening on each of said sides for varying a width of the platform;

a height adjustable support structure connected to said platform for suspending said platform a select distance above an underlying surface, wherein said support structure includes:

a hub having a plurality of support legs radially extending therefrom, said hub including a centrally disposed, internally-threaded bore;

an elongated, externally threaded support rod received within said bore whereby rotation of said rod results in extension and retraction of said rod relative to said bore.

2. The footrest according to claim 1 further comprising means for adjusting the angular orientation of said platform.

3. The footrest according to claim 2 wherein said means for adjusting the angular orientation of said platform comprises:

a pair of spaced, substantially circular restraining rings secured to the bottom surface of the platform, each of said kings having an annular, serrated inner surface;

an insert at an upper end of said rod, said insert having a continuous, annular geared surface on each of two opposing sides thereof, each geared surface intermeshing with the serrated surface of each of said restraining rings when the insert is positioned therebetween to fix the platform at a select angle;

means for fixing the relative positions of said rings and said insert.

4. The footrest according to claim 3 wherein means for fixing the relative positions of said rings and said insert comprises said restraining rings and said insert each including a horizontal passageway with a carriage bolt received therein;

a knob threadedly secured to the carriage bolt which is tightened to firmly secure the support rod to the platform.

5. An ergonomic footrest comprising:

a substantially planar footrest platform having an upper surface, a lower surface and two opposing sides, each of said sides including an opening in communication with a hollow interior;

a cushioned layer positioned on the upper surface of the platform for enhanced comfort;

an extension slidably received within said opening on each of said sides for varying a width of the platform;

a hub having a centrally disposed, internally-threaded bore;

an elongated, externally threaded support rod, said support rod having an upper end and a lower end, said lower end received within said bore, said upper end secured to said platform whereby rotation of said rod results in extension and retraction of said rod relative to said bore to raise and lower said platform.

6. The footrest according to claim 5 further comprising means for adjusting the angular orientation of said platform.

7. The footrest according to claim 6 wherein said means for adjusting the angular orientation of said platform comprises:

a pair of spaced, substantially circular restraining rings secured to the bottom surface of the platform, each of said rings having an annular, serrated inner surface;

an insert at an upper end of said rod, said insert having a continuous, annular geared surface on each of two opposing sides thereof, each geared surface intermeshing with the serrated surface of each of said restraining rings when the insert is positioned therebetween to fix the platform at a select angle;

means for fixing the relative positions of said rings and said insert.

8. The footrest according to claim 7 wherein means for fixing the relative positions of said rings and said insert comprises said restraining rings and said insert each including a horizontal passageway with a carriage bolt received therein;

a knob threadedly secured to the carriage bolt which is tightened to firmly secure the support rod to the platform.

* * * * *